United States Patent [19]

Szücs et al.

[11] Patent Number: 4,813,237

[45] Date of Patent: Mar. 21, 1989

[54] APPARATUS FOR MAKING UP FEED WATER FOR A POWER STATION

[75] Inventors: László Szücs; István Szabo; István Papp, all of Budapest; József Csaszni, Oroszlány; Gyula Lengyel, Budapest; Pál Resch, Budapest; Emőd Sigmond, Budapest; Péter Kardos, Budapest, all of Hungary

[73] Assignee: Energiagazdálkodási Intézet, Budapest, Hungary

[21] Appl. No.: 234,452

[22] Filed: Aug. 19, 1988

[51] Int. Cl.[4] ..... F01K 19/10

[52] U.S. Cl. ..... 60/670; 60/657; 60/648

[58] Field of Search ..... 60/646, 648, 657, 670

[56] References Cited

U.S. PATENT DOCUMENTS

| | | | |
|---|---|---|---|
| 2,893,926 | 7/1959 | Worthen et al. | 60/648 X |
| 3,476,653 | 11/1969 | Doland | 60/648 X |
| 3,489,652 | 1/1970 | Williamson | 60/648 X |
| 4,186,058 | 1/1980 | Katz et al. | 60/648 X |

*Primary Examiner*—Allen M. Ostrager

*Attorney, Agent, or Firm*—Jordan and Hamburg

[57] ABSTRACT

The invention relates to an apparatus for making up feed water for a power station having a steam circuit with a steam turbine /3/ and a feed water circuit with a turbine condenser /5/. The apparatus comprises aregulated multi-stage adiabatic evaporator/5/ produces distillate from raw water for making up the feed water. The heating inlet /8/ of the evaporator /15/ is connected to the stream circuit through an ejector /14/. The distillate outlet /36/ of the evaporator /15/ providing distillated water, is connected to the feed water circuit at the turbine condenser /5/ or after it through water delivering means /19, 20/.

9 Claims, 2 Drawing Sheets

APPARATUS FOR MAKING UP FEED WATER FOR A POWER STATION

TECHNICAL FIELD

The subject matter of the invention is an apparatus for making up feed water for a power station.

BACKGROUND ART

Electric power is often generated in a thermal power station having closed cycle with water as work medium. Due to various reasons, the water leaves the cycle, and it should be substituted by very clean water/ of approximately 0.1 μS/cm conductivity/. The clean water is to be produced from a much more contaminated water /hereinafter raw water/ to be found in the vicinity of the power station. This operation is called the making up of feed water for the power station.

Earlier, the distillate for making up feed water was produced in the form of steam by an evaporator device matched to the system of the power station. The evaporator device was e.g. connected between two bleedings of the steam turbine. Nowadays, the production of the make-up water of the required purity is mostly based on a so-called complete desalination equipment consisting of ion exchange devices, cation and anion exchanging columns.

The application of evaporator devices was uneconomical in most cases because they were either of simple operation with a high steam consumption, or of multi-body type, in the latter case their start-up and stopping entailed problems, since it was possible in a longer period only, and resulted in a huge steam loss, as well as in a regulation requirement, causing serious difficulties in the operation of the power station.

There are equipments based on ion exchange for producing make-up water. They have a double disadvantage: on the one hand, the chemicals are costly, and on the other hand, due to regeneration, chemicals are introduced into the environment, mostly into live waters. The quantity of contaminating materials introduced in the environment increases together with the contamination of the raw water. Since the available raw waters are increasingly contaminated, the chemical consumption also increases, and the entailed environment pollution is starting to be unbearable today. Therefore, the environment protection and the costs of chemicals dramatically increase the costs of ion exchange processes.

Equipment based on reverse osmosis has already been suggested for producing make-up water. However, the purity of water supplied by reverse osmosis is not satisfactory for power station purposes, so it is inevitable to use an ion exchange device after this unit. On the other hand, the energy required for driving the reverse osmosis devices should be supplied in the form of mechanical energy, therefore in the case of power station start-up, its availability under any condition should be ensured by diesel power generator or a co-operation network.

DISCLOSURE OF THE INVENTION

The invention is based on the idea that instead of or together with the ion exchange type water treatment device applied in a wide range at present, a special type of multi-stage adiabatic evaporator, the so-called regulated multi-stage adiabatic evaporator, is used and its input steam side is supplied by steam obtained from the steam circuit of the power station and its output distillated water side is connected to the feed water circuit of the power station.

Thus, the invention is an apparatus for making up feed water for a power station having a steam circuit with a steam turbine and a feed water circuit with a turbine condenser and at least one preheater for the condensate, the apparatus comprising an evaporator device for producing distillate from raw water for making up the feed water, said evaporator device having a heating inlet fed by steam taken from the steam circuit. The apparatus comprises a regulated multi-stage adiabatic evaporator having a heating inlet and a distillate outlet providing distillated water, and an ejector having a drive inlet, an intake inlet and an outlet; the heating inlet of the evaporator being connected to the outlet of the ejector, the drive inlet of the ejector being connected to a first point of the steam circuit and the intake inlet being connected to a second point of the steam circuit, the steam pressure at said second point being smaller than that at said first point, and the distillate outlet of the evaporator being connected through water delivering means into the feed water circuit of the power station.

The upper temperature of a regulated multi-stage adiabatic evaporator is quite fixed due to the series-type manufacture. When the load changes, both the upper temperature of the evaporator and the bleeding pressures of the steam turbine may change. To eliminate this disadvantage, according to the invention, the steam is taken from the steam circuit through an ejector. The driving steam of the ejector is received from a first point of the steam circuit, the pressure of which is higher than the steam pressure prescribed for heating the evaporator, and the intake inlet of the ejector is connected to a second point of the steam circuit, the pressure of which is lower than said prescribed steam pressure. The driving steam can be taken from the steam inlet or from an upper bleeding of the steam turbine, the intake inlet can be connected to a lower bleeding or to the steam outlet of the steam turbine. Thus, it becomes possible for that part of the steam which is required for heating the evaporator to expand up to the lower bleeding or to the turbine condenser in the steam turbine, and so extra electric power can be generated.

In the current power station practice, the approach of the invention is entirely unusual. This fact can be probably explained by the following considerations:

In the power stations the water work medium is available in the form of steam at several pressures /bleeding pressures on the steam turbine/ and the distillate produced can be fed back into the water cycle also at several pressure and temperature levels. Therefore, it seemed to be obvious to connect the evaporator between two available adjacent pressure levels, and to feed back the distillate at the temperature at which it is produced. Compared with this solution, which is optimally matched to the system of the power station in a thermodynamical sense, all other approaches might only be disadvantageous. Then, in order to ensure a high efficiency evaporation, multi-stage adiabatic evaporators generally include very large water spaces, and the throttling of pressure stages must be regulated already in the case of small changes in the loading and parameters, which results in a difficult adjustment process and tedious energy-intensive start-up.

It has been realized by the present invention that these statements—although they are more or less true in themselves—leave the following conditions out of consideration:

The resulting distillate can be cooled in a thermodynamically identical way in some evaporator types, e.g. in a multi-stage adiabatic evaporator, therefore the introduction of the distillate at a cold temperature in the form of water is not necessarily disadvantageous from a thermodynamical aspect. Further, the recently developed, regulated version of the multi-stage adiabatic evaporator can be started up rapidly and simply, the throttles between the stages do not require adjustment, the extra steam consumption of start-up is minimal, and the water space is small. These evaporators ensure an evaporation of good efficiency by special devices, by nozzles, therefore the large water space and the adjustable throttles could be eliminated.

According to the invention a reliable make-up water producing plant can be established which is very economic, provides a water quality identical with that of an ion exchange plant, can be treated easily, can be started up and stopped rapidly and, in addition, causes an environment pollution of very low level.

In the case there is a condense treatment device in the feed water circuit after the turbine condenser, for continuous elimination of impurities getting into the feed water in consequence of system imperfections, it is of advantage to introduce the distillate between the turbine condenser and the condense treatment device. So, a further diminishing of the salt content of the distillate produced by the evaporation is achieved with an insignificant extra load on the condense treatment device /e.g. the number of regeneration per year increases approximately from 30 to 40/. This configuration makes the installation of a post-treatment device unnecessary and results in a saving in investment costs.

The salt content of the distillate produced by the regulated multi-stage adiabatic evaporator according to the invention is very low. However, it may happen that in special power station applications a salt content of even smaller is necessary, e.g. a few times 0.01 p.p.m., and there is no condense treatment device in the feed water circuit. In such cases it is advantageous to diminish the salt content of the distillate by an ion exchange device before introducing it into the feed water circuit. The salt content could be diminished by a more perfect and therefore more expensive evaporator, too. However, the investment costs of the above combined solution, i.e. an evaporator of normal type and an ion exchange device thereafter, are smaller. The combined solution is also advantageous as compared with the production of the make-up water only by an ion exchange equipment, because of a less environment pollution. An evaporator of normal type diminishes the salt content of the raw water to less than its one thousandth, so the ion exchange device has to treat a water with very small quantity of impurities, therefore the environment pollution caused is very small, too.

We should also point out another advantage, in comparison with the conventional power station evaporator devices applied earlier, if a regulated multi-stage adiabatic evaporator is applied for preparing make-up water for the power station according to the invention. This advantage is given by the fact that the conventional evaporators introduced the distillate in the form of steam into the system, while the evaporator according to the invention does this in the form of liquid. According to the invention, the purity of the liquid distillate can be constantly observed by a simple conductivity meter, and if the quality of distillate deteriorates due to any problem, the distillate is simply fed back by an automatic system to the evaporator, i.e. it is not introduced into the feed water circuit of the power station. At the same time an alarm signal can be generated. On the contrary, in the conventional evaporator device, an eventual foaming—that may occur in this evaporator type already at simple change of loading—is indicated only by the deterioration of the feed water quality, and so the bad feed water is inevitably introduced into the boiler of the power station.

BRIEF DESCRIPTION OF THE DRAWINGS

The invention will be described on the basis of embodiments shown in the drawings, wherein.

MODES FOR CARRYING OUT THE INVENTION

Figure 1:
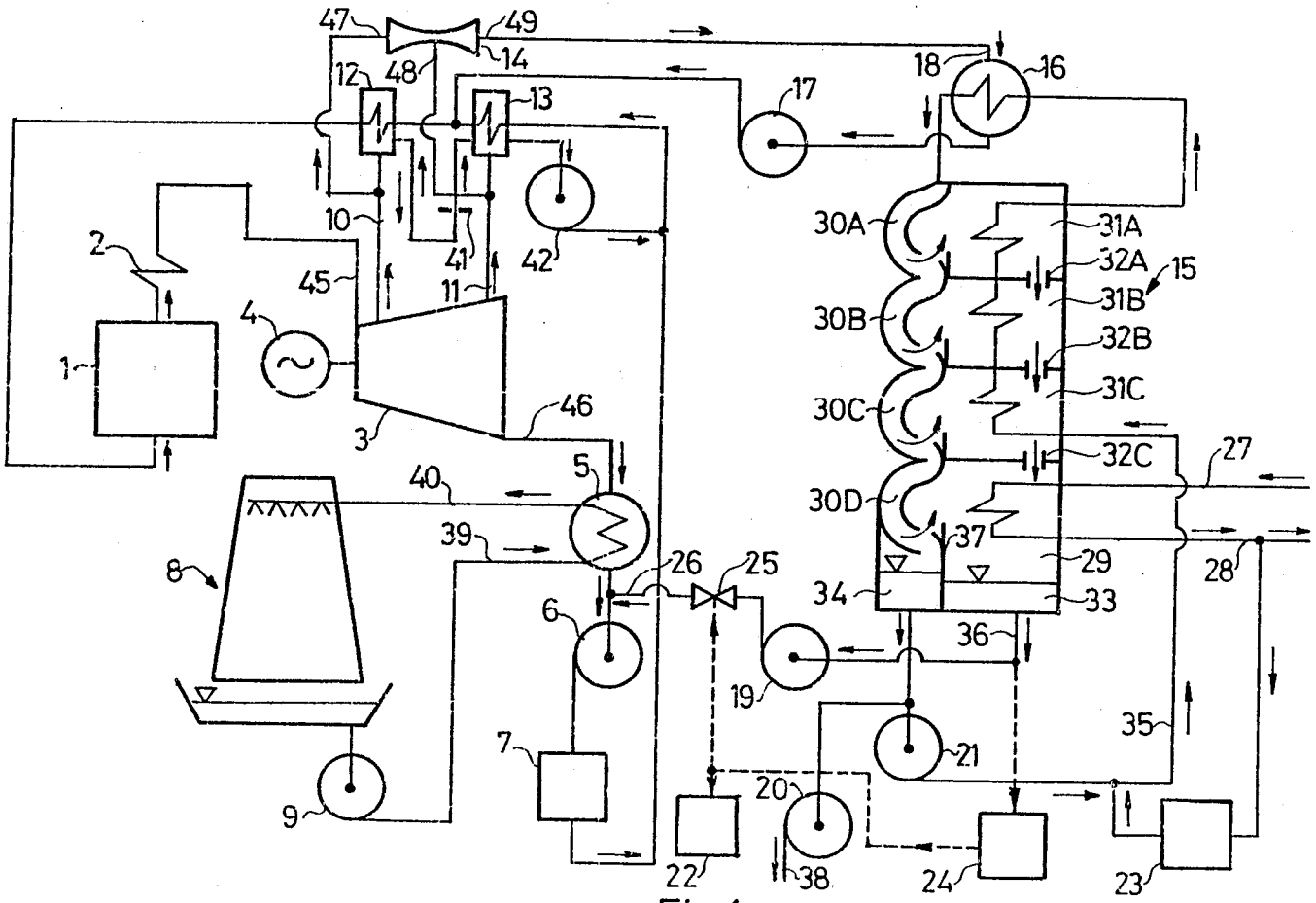
FIG. 1 shows a schematic thermo-engineering circuit diagram of one embodiment of the apparatus according to the invention, when it is applied for a thermal power station.

In FIG. 1 a thermal power station comprises a boiler 1 producing steam from feed water. The steam is conducted across a superheater 2 to the steam inlet 45 of a steam turbine 3 and drives the steam turbine 3 to which a power generator 4 is connected. The steam expanded in the steam turbine 3 flows through the steam outlet 46 into a turbine condenser 5, where it is condensed. From here the feed water is fed back to the boiler 1 through a condense treatment device 7 as well as feed water preheaters 13 and 12 by a feed water pump 6. Thus, the closed cycle of the water work medium consists of a steam circuit from the boiler 1 to the turbine condenser 5, and a feed water circuit from the turbine condenser 5 to the boiler 1.

The cooling water of the turbine condenser 5 is circulated by a pump 9, via inlet 39 and outlet 40, through a cooling tower 8. The condense treatment device 7 is generally an ion exchange type water treatment unit, with the function of eliminating the contaminating effect of the cooling water introduced into the feed water in the case of leaking any of the pipes of the turbine condenser 5. This condense treatment device 7 also makes sure about continuously filtering the contaminations introduced in the feed water due to imperfections of the system. The feed water leaves the turbine condenser 5 at a cold temperature, therefore the condense treatment device 7 treats cold feed water.

The cold feed water exiting from the condense treatment device 7 is preheated by the steam resulting from an upper bleeding 10 and a lower bleeding 11 of the steam turbine 3 in feed water preheaters 13 and 12. In the embodiment depicted by way of example, the condensate is fed from the preheater 12 through a throttle 45 to the preheater 13, and together with the condensate there it is supplied into the feed water circuit by a pump 42. The figure only shows two bleedings 10 and 11 and the corresponding two feed water preheater 12 and 13, but in a given case more such units may also be applied and instead of the upper bleeding 10 and the lower bleeding 11 the connection may also be made to the steam inlet 45 and outlet 46 of the steam turbine 3, respectively. Instead of the boiler 1, a different type of steam generating unit e.g. a nuclear reactor may also be applied.

The apparatus according to the invention includes a regulated multi-state adiabatic evaporator 15, which comprises regulated adiabatic evaporator stages using series-connected 30A, 30B, 30C and 30D nozzles for the water heated to an appropriate temperature and of an appropriate pressure. The distillate evaporated in each stage is condensed in the spaces of heat recovery stages 31A, 31B and 31C and in the space of a cooling stage 29, and collected in a vessel 33. The spaces of the heat recovery stages 31A, 31B and 31C and that of the cooling stage 29 are connected in series by distillate nozzles 32A, 32B and 32C. The water to be heated up flows in countercurrent in the heat recovery stages 31A, 31B and 31C, and before introduction into the nozzle 30A of the first stage, it is further heated to the initial temperature necessary for the adiabatic evaporation by a water heater 16. The water flowing through the nozzles 30A, 30B, 30C and 30D is condensing as a result of the continuous evaporation and will be collected in a vessel 34. The brine collected in the vessel 34 is partly fed back by a pump 21 into the circulation cycle 35 of the evaporator 15, and partly removed from the evaporator 15 through a conduit 38 by a pump 20. The distillated water collected in the vessel 33 is introduced by a pump 39 via distillate outlet 36 and through a conduit 26 as a make-up water into the feed water circuit of the power station between the turbine condenser 5 and the condense treatment device 7, in the embodiment shown in FIG. 1 it is introduced between the turbine condenser 5 and the feedwater pump 6. A valve 25 is fitted into the distillate conduit 26, for the purpose to be described below.

A measuring unit 24 is connected to the distillate outlet 36 for monitoring the pollution material content of the distillate. The output of the measuring unit 24 is partly connected to a control input of the valve 25 and partly to a trigger input of an alarm unit 22. For example the measuring unit 24 can be a device measuring the conductivity of the distillate, and so above a predetermined conductivity limit it causes the closing of the valve 25 and also an alarm signal by the alarm unit 22. By closing the valve 25, the outlet of the make-up water is stopped and, as a result, the level of the distillate rises in the collecting vessel 33, consequently the distillate flowing over the weir 37 is introduced into the vessel 34 and then into the circulation cycle 35.

Contrary to the drawing, there may be several cooling stages 29 in the evaporator 15. The cooling is ensured by cooling water introduced at an inlet 27 and leaving at an outlet 28. In a given case, the inlet 27 can be connected to the inlet 39 for the cooling of the power station, and accordingly the outlet 28 can be connected to the outlet 40. From the heated up raw water exiting at the outlet 28, the circulation cycle 35 of the evaporator 15 receives make-up water through a water treatment equipment 23. This equipment 23 should be selected according to the available quality of the raw water. In most cases filtering and using of some p.p.m. of settling inhibitor chemical are sufficient, e.g. feeding in the chemical Drewsperse 747/A produced by Drew Ameroid IC company, as well as degassing. The treated raw water introduced into the circulation cycle 35 should replenish the water quantity leaving from the evaporator 15 through the distillate outlet 36 and the brine conduit 38. Contrary to the drawing, the water replenishment of the evaporator 15 may be provided not only by the cooling water but also by other type of raw water.

The water heater 16 of the evaporator 15 is heated by the steam from the steam turbine 3. To do this, an ejector 14 is used. The drive inlet 47 and the intake inlet 48 of the ejector 14 is connected to the bleedings 10 and 11, respectively, of the steam turbine 3. The outlet 49 of the ejector 14 is connected to the steam inlet of the water heater 16, this steam inlet represents the heating inlet 18 of the evaporator 15. The application of the per se known ejector 14 ensures that the pressure of the steam supplying the water heater 16 can be adjusted to a value between the steam pressures at the bleedings 10 and 11. The steam condensed in the water heater 16 is returned by a pump 17 into the feed water circuit of the power station, between the feed water preheaters 13 and 12.

Figure 2:
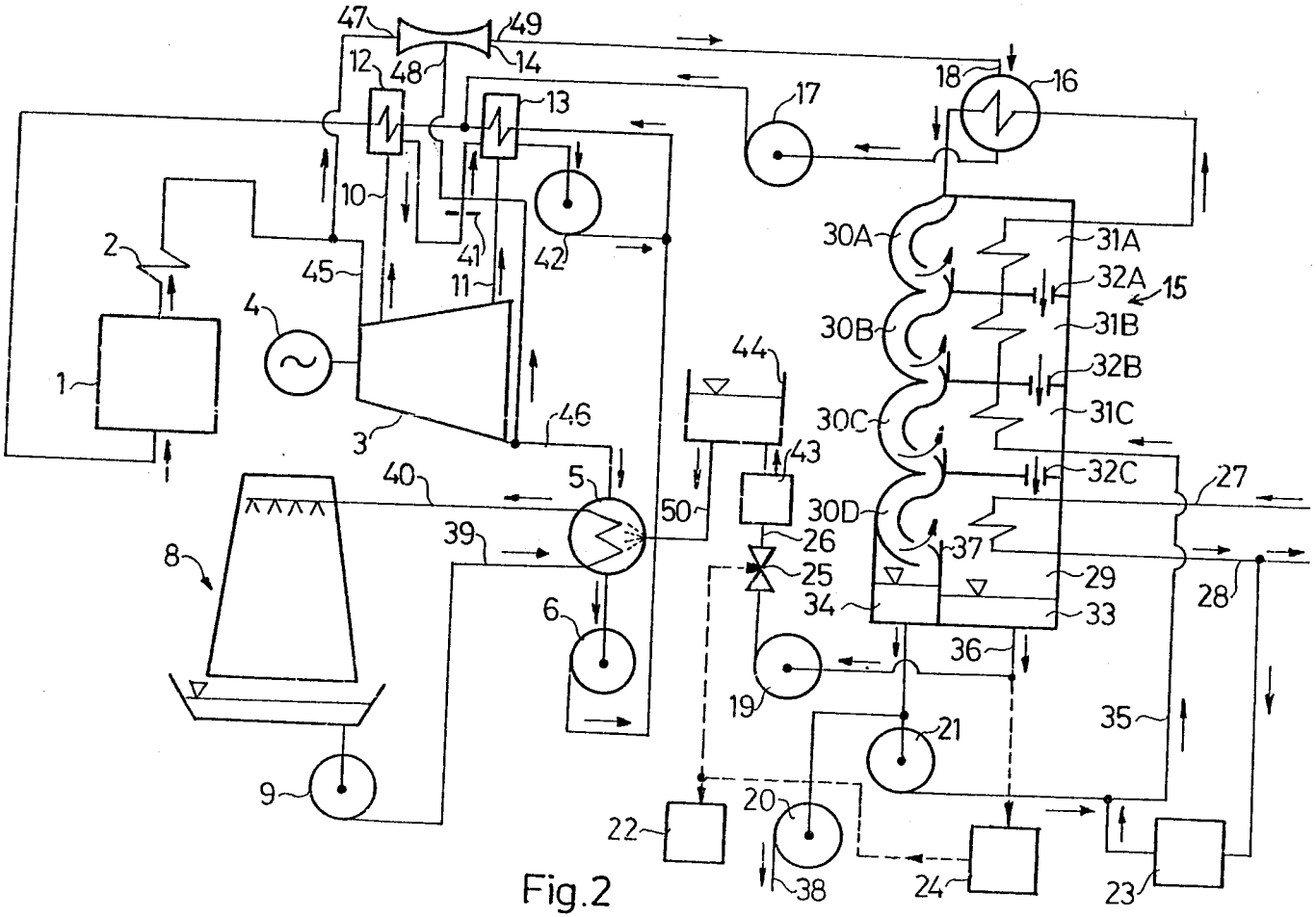
FIG. 2 shows a schematic circuit diagram of another embodiment of the apparatus in connection also with a thermal power station.

The evaporator 15 shown in FIGS. 1 and 2 has only four stages for better understanding, but the actual design may be much larger, e.g. it is advisable to apply a regulated multi-stage adiabatic evaporator 15 consisting of 25 to 30 stages.

In FIG. 2 the circuit diagram of an apparatus similar to that of FIG. 1 is shown, where the same elements are denoted by the same reference numbers. In the following the differences are described, only.

In FIG. 2 the feed water circuit of the power station does not include a condense treatment device after the turbine condenser 5, the pump 6 delivers the feed water directly into the preheater 13. The water delivering means between the distillate outlet 36 and the feed water circuit of the power station are different from those of FIG. 1. In the distillate conduit 26, after the pump 19 and the valve 25, there is an ion exchange device 43 inserted for diminishing the salt content of the distillate before entering into the feed water circuit. The conduit 26 ends in a distillate storing tank 44 from which the distillate is introduced into the feed water circuit at the turbine condenser 5 by a conduit 50.

On the heating side of the evaporator 15, the drive inlet 47 and the intake inlet 48 of the ejector 14 are connected to the steam inlet 25 and steam outlet 46 of the steam turbine 3, respectively. The heating inlet 18 is connected to the outlet 49 of the ejector 14, similarly to FIG. 1.

| LIST OF REFERENCE NUMBERS | |
|---|---|
| 1 | boiler |
| 2 | superheater |
| 3 | steam turbine |
| 4 | generator |
| 5 | turbine condenser |
| 6 | pump |
| 7 | condense treatment device |
| 8 | cooling tower |
| 9 | pump |
| 10 | bleeding |
| 11 | bleeding |
| 12 | preheater |
| 13 | preheater |
| 14 | ejector |
| 15 | evaporator |
| 16 | water heater |
| 17 | pump |
| 18 | heating inlet |
| 19 | punp |
| 20 | pump |
| 21 | pump |
| 22 | alarm unit |
| 23 | water treatment equipment |
| 24 | measuring unit |
| 25 | valve |
| 26 | conduit |

-continued

| LIST OF REFERENCE NUMBERS | |
|---|---|
| 27 | inlet |
| 28 | outlet |
| 29 | cooling stage |
| 30 | A, B, C, D nozzle |
| 31 | A, B, C heat recovery stage |
| 32 | A, B, C distillate nozzle |
| 33 | vessel |
| 34 | vessel |
| 35 | circulation cycle |
| 36 | distillate outlet |
| 37 | weir |
| 38 | conduit |
| 39 | inlet |
| 40 | outlet |
| 41 | throttle |
| 42 | pump |
| 43 | ion exchange device |
| 44 | tank |
| 45 | steam inlet |
| 46 | steam outlet |
| 47 | drive inlet |
| 48 | intake inlet |
| 49 | outlet |
| 50 | conduit |

What is claimed:

1. An apparatus for making up feed water for a power station having a steam circuit with a steam turbine and a feed water circuit with a turbine condenser and at least one preheater for the condensate, the apparatus comprising an evaporator device for producing distillate from raw water for making up the feed water, said evaporator device having a heating inlet fed by steam taken from the steam circuit, characterized by comprising a regulated multi-stage adiabatic evaporator /15/ having a heating inlet /18/ and a distillate outlet /36/ providing distillated water, and an ejector /14/ having a drive inlet /47/, an intake inlet /48/ and an outlet /49/; the heating inlet /18/ of the evaporator /15/ being connected to the outlet /49/ of the ejector /14/, the drive inlet /47/ of the ejector /14/ being connected to a first point of the steam circuit and the intake inlet /48/ being connected to a second point of the steam circuit, the steam pressure at said second point being smaller than that at said first point, and the distillate outlet /36/ of the evaporator /15/ being connected through water delivering means into the feed water circuit of the power station.

2. The apparatus according to claim 1, characterized in that said first point of the steam circuit is a steam inlet /45/ or an upper bleeding /10/ of the steam turbine /3/, the pressure of which being higher than a steam pressure prescribed at the heating inlet /18/ of the evaporator /15/, and that said second point of the steam circuit is a steam outlet /46/ or a lower bleeding /11/ of the steam turbine /3/, the pressure of which is smaller than said prescribed steam pressure.

3. The apparatus according to claim 1, characterized in that the distillate is introduced into the feed water circuit between the turbine condenser /5/ and said at least one preheater /13/.

4. The apparatus according to claim 1, characterized in that the distillate is introduced into the feed water circuit at the turbine condenser /5/.

5. The apparatus according to claim 1, characterized in that the feed water circuit further comprises a condense treatment device /7/ connected after the turbine condenser /5/, and the distillate is introduced into the feed water circuit between the turbine condenser /5/ and the condensate treatment device /7/.

6. The apparatus according to any of claim 1, characterized in that the water delivering means comprise a pump /19/, an ion exchange device /43/ and a water supply tank /44/.

7. The apparatus according to claim 1, characterized in that the regulated multi-stage adiabatic evaporator /15/ has an inner circulation cycle /35/ comprising series-connected heat recovery stages /31A, 31B, 31C/ for heating up the water gradually, a water heater /16/ for further heating up the water, series-connected nozzles /30A, 30B, 30C, 30D/ for gradual and regulated evaporation of the heated water, said nozzles being associated with the heat recovery stages /31A, 31B, 31C/ and with at least one cooling stage /29/ for condensing the distillate which is collected in a vessel /33/, wherein said heating inlet /18/ is provided for the water heater /16/ and said distillate outlet /36/ is connected to the vessel /33/.

8. The apparatus according to claim 7, characterized by further comprising a measuring unit /24/ for monitoring the polluting material content of the distillate, a valve /25/ in a conduit /26/ connected to the distillate outlet /36/ and an alarm unit /22/ producing an alarm signal upon its actuation, the valve /25/ and the alarm unit /22/ being connected to an output of the measuring unit /24/.

9. The apparatus according to claim 7, characterized by further comprising means to supply the inner circulation cycle /35/ of the evaporator /15/ with raw water from a cooling water outlet /28/ of said at least one cooling stage /29/, said supply means including a water treatment equipment /23/ for diminishing the polluting material content of the raw water.

* * * * *